United States Patent [19]

Milles et al.

[11] 4,385,509

[45] May 31, 1983

[54] PERMUTATION LOCK

[75] Inventors: Peter Milles, Alberthofen; Rudi Düringer, Wuppertal, both of Fed. Rep. of Germany

[73] Assignee: S. Franzen Söhne (GmbH & Co.), Solingen, Fed. Rep. of Germany

[21] Appl. No.: 205,137

[22] Filed: Nov. 10, 1980

[30] Foreign Application Priority Data

Nov. 27, 1979 [DE] Fed. Rep. of Germany ..... 2947677
Oct. 11, 1980 [DE] Fed. Rep. of Germany ..... 3038481

[51] Int. Cl.[3] ..... E05B 37/02
[52] U.S. Cl. ..... 70/304; 70/312
[58] Field of Search ..... 70/214, 220, 288, 304, 70/305, 312, 313

[56] References Cited

U.S. PATENT DOCUMENTS 543,404 7/1895 Root ..... 70/313
1,582,663 4/1926 Bastian ..... 70/313
3,851,507 12/1974 Gehrie ..... 70/312
4,027,508 6/1977 McGourty ..... 70/214
4,287,734 9/1981 Herriott ..... 70/312

*Primary Examiner*—Robert L. Wolfe
*Attorney, Agent, or Firm*—Martin A. Farber

[57] ABSTRACT

A permutation lock with an opening actuating handpiece and with a plurality of axle-mounted discs which bear symbols, which lie behind viewing windows in a front plate of the lock housing and lock in their individual angular positions, and adjacent thereto with locking sleeves which have engagement spaces for projections of a spring-biased blocking slide which is actuatable from the outside, the engagement spaces being opposite to the direction of movement of the projections of the blocking slide when the combination is properly set. Each of the individual discs can be actuated, with the interposition of a stepping mechanism, via a push button which is adjacent to the viewing windows.

6 Claims, 18 Drawing Figures

PERMUTATION LOCK

The present invention relates to a permutation lock (also called a combination lock) having an opening actuating handpiece and having a plurality of axle-mounted discs, bear symbols which lie behind viewing windows in the front plate of the lock housing and lock in individual angular positions, and having, adjacent to them, locking sleeves which have engagement spaces for projections of a blocking slide which is actuatable from the outside and spring-biased in direction of closing, the engagement spaces lying opposite the direction of movement of the blocking slide projections when the combination is properly set.

In known permutation locks, the position of readiness for opening is produced by turning the disks. Since as a rule rather small disks and furthermore only a portion thereof form the actuating surface, the displacement is frequently difficult in the case of correspondingly small angular amounts, particularly if one's fingers are moist or one fails to remove one's gloves. Frequently, also, only a negligibly small region remains for the visible application of the opening symbol, since peripheral detent notches still further reduce the size of the corresponding fields. There is also the disadvantage that the shaft is subjected to considerable load by the contact pressure, leading to disturbances in operation in the case of low-price constructions. Finally, it is also found disadvantageous that the actuating finger conceals the symbol of the opening combination which is to be set upon performing the displacement. This latter disadvantage is not present in the case of all constructions, since there are also constructions in which the symbol is located in position adjacent the setting disk.

The object of the present invention is to develop a permutation lock of the above-indicated type which is easier to operate while avoiding these disadvantages and at the same time even increasing the difficulty of "picking" such locks.

In accordance with the invention each separate disc can be actuated by means of a stepping mechanism via a push button which is adjacent the viewing windows.

As a result of this development, a permutation lock of this type which is in particular of increased utilitarian value is obtained: the disks which bear the symbols are actuated in precisely defined stepwise sequence by means of conveniently operated push buttons. Moving beyond the angular positions no longer occurs. The actuating force can be introduced in favorable manner. The shaft is no longer subject to any transverse loads. By the interposition of a push button and the indirect displacement of the disks obtained thereby the assurance against "picking" is considerably increased; an unauthorized person no longer easily obtains, by "stethoscope" a clear idea as to the configuration of the readiness-for-opening position. The structural means are simple and suitable. Thus the push button is provided with an elastically yieldable switch finger at the end thereof located on the inside of the lock. This finger can be formed directly on it, in a manner favorable for manufacture. The finger of the stepping mechanism, which finger turns the disk stepwise upon corresponding pressure on the button, engages between prongs of a star wheel provided on the wide side of the disk. Such a star wheel may suitably be formed on the disk at the same time as its production. Relatively thin disks can furthermore be strengthened in this manner. The angular position assumed can be held by friction or else in the manner by a one-sided acting detent ratchet associated with each of the locking sleeves. In this way easy displacement of the disks is obtained. If the further development is such that the disks and the locking sleeves are connected with each other by a detent coupling then the locking mechanism at the same time assumes the function of a combination resetting device. For this it is merely necessary that the projections of the slide enter into the engagement spaces of the locking sleeves. The depressing of the push buttons, when the locking sleeves are correspondingly held in position, then leads to a relative displacement of the disks with respect to the locking sleeves. After resetting, the operator need merely release the spring-biased slide. The lock is then ready for use in its newly coded form. The forces which act on the locking sleeve from the side of the detent lock are of such a nature that the detent coupling cannot be done away with solely by this, as a result of which the resetting of the combination can be brought about only when actually intended. Instead of a push-button actuation perpendicular to the disk shaft, this actuation can also be parallel in space to the disk shaft (FIG. 5), whereby it is possible even to obtain a flat lock. This development is obtained in the manner that the push button acts via an oblique surface on a slide which has a switch finger which yield elastically and the angularly bent actuating end of which comes between prongs of the star wheel which is provided on the wide side of the disks. In order to employ the same favorable manner of operation also for the drawing back of the block slide, the slide is also displaced in the opening direction by means of a push button. Here control bevels of about 45° can be taken as a basis. Particularly in the case of the introductorily discussed illustrative embodiment, a construction which is favorable both in manufacture and in assembly is obtained where the axle bearing of the disks and locking sleeves is formed by stub shafts of the two parts such that a stub shaft of the locking sleeve enters into a depression in the disk which in its turn is held with a stub shaft in an opening in an intermediate wall of the lock housing by the axial resilience of the detent ratchet whose spring tongues are seated on a plate which lies, by means of a collar, in a depression in the lock wall, said plate having an opening for the entrance of a second stub shaft of the locking sleeve. A suitable shaping of the shafts permits plug-type insertion in the manner of an axial alignment of the parts which then, as a pre-assembled structural unit, need only be lowered from above into the lock case. It is furthermore of advantage that the partition-wall-side opening is provided in a push-in plate. The spring tongues of the detent ratchet which tongues supported on the push-in plate, act on the structural parts, which are plugged into each other, in the direction of engagement. Finally, another advantageous feature resides in the fact that the actuating handpiece of the blocking slide is formed as a slide button which can be locked by a key. Such a slidebutton actuating handle is favorable in particular in the case of so-called central locks in connection with which two correspondingly centrally controlled latches are simultaneously moved into the opening position. Thus the possibility of both mating lock parts being released simultaneously by an unintended single push-button actuation is avoided.

In order, with an advantageous development effectively to exclude the possibility that one or the other locking sleeve can be jammed fast via the opening-actuating push button and the blocking slide displaced by it and thus, with actuation of the stepping mechanism, a changing of the lock combination can deliberately be brought about, it is furthermore proposed in accordance with the invention that the opening-actuating button which is formed as a push button be developed in U shape at its inner end, the one end of the blocking slide, when the secret combination is incorrectly set, lying below the one arm of U and an inner flank of the other arm of the U acting on a control projection for the hook latch, and that the side edges of the two U arms are connected by an arm on which the return spring of the opening-actuating button acts.

As a result of this development, the reliability in use of the permutation lock is optimalized: The movement of depression of the opening actuating handle is now no longer converted into a displacement of the blocking slide. Accordingly one avoids the disagreeable possibility of so jamming one or the other locking sleeves via the blocking slide that, with actuation of the combination resetting device, the secret combination is falsified, i.e. intentionally or unintentionally changed.

The functional relationship between the blocking slide and the opening-actuating button which acts on it resides in the fact that the blocking slide which rests against the locking sleeves lies as a blocking agent within the path of movement of the button. Thus "picking" is also for all practical purposes out of the question. Only when the proper combination has been set, does the blocking slide move forward rapidly, with its projections entering into the engagement spaces of the locking sleeves. By this displacement the path of the opening-actuating button is freed. By its actuation the hook latch which is associated with the blocking slide can be released in a suitable manner. If the button is held in the depressed position, then the correct, foolproof combination-reset ready-position is present, since the button lies in movement-blocking manner in front of the end of the blocking slide.

From a structural standpoint it is furthermore advantageous for the opening-actuating button which is developed as a push button to be U-shaped at its inner end, the one end of the blocking slide lying below the one arm of the U when the combination is improperly set and an inner flank of the other U arm striking against the control projection of the hook latch. Such a development proves functionally reliable and of low maintenance. Furthermore there is a high inner stability which is fully sufficient for the customary actuating forces. In this respect, it is furthermore advantageous that the side edges of the two U arms be connected by a web on which the return spring of the opening-actuating button acts. With such a development the opening-actuating button can even be made of plastic. An advantageous association of the means holding the hook latch in the closed basic position is established by the fact that the hook latch has a tunnel which is crossed by the blocking slide spring and into which a return spring of the hook latch engages. Another advantageous development is established by a stepping mechanism with two switch fingers which lie, laterally apart, opposite the star wheel of the disk, each of the switch fingers having a driving flank and a blocking flank in such a manner that alternately upon the inward and outward displacement of the push button the blocking flank of one switch finger strikes parallel to and against the tooth flank of the star-wheel teeth and the driving flank of the other switch finger strikes the star-wheel tooth at an acute angle. This leads to a reduced structural height since the path of stroke is formed half by the depression movement and half by the return movement of the opening-actuating button. In this way the freely extending portion of the button which serves to receive the finger which actuates it also need not protrude by such a large amount beyond the front plate.

Further advantages and details of the subject matter of the invention will be explained in further detail below with reference to several embodiments shown in the drawing, in which FIG. 1 shows the permutation lock of the invention with a hasp part as a mating-locking part, shown in perspective in accordance with the first embodiment.

Figure 1:
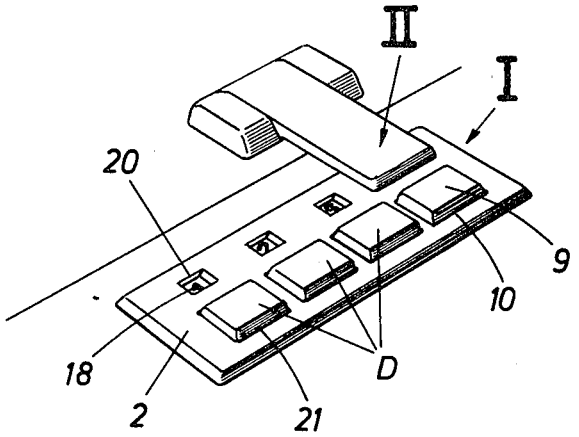

The permutation lock shown comprising a permutation lock part I which, in accordance with the first and third embodiments (FIGS. 1 to 5 and 11 to 18 respectively) cooperates with a hasp closure part II while in the second embodiment it cooperates with locking tongues III of a central closure.

An elongated rectangular lock housing 1 forms part of the permutation lock part I. This housing is closed on top by a front plate 2.

A blocking slide 4 extends below the front plate 2 in the vicinity of one long wall 3 of the lock housing. The slide is biased by a spring 5 into the closing direction (arrow x, see FIG. 3). Another spring 7 which is fixed at one end is formed as a convolution spring and engages on the hasp-side end on the blocking side 4. The latter carries an associated side nose 4' which is longitudinally displaceable independently of the movement of the slide in the same direction. The nose 4' snaps in latch-like manner into an eye of a lug 6 of the mating closing part II which in this case is formed as a hasp. The latch spring 7 extends rearwardly of the slide nose 4' and rests against a shoulder of the slide. For the passage of the lug 6 the front plate 2 has an opening 8. The lug 6 which strikes the bevel of the latch displaces the slide nose 4' in the opening direction without the blocking slide 4 being thereby carried along.

For the displacement of the blocking slide 4 in the direction opposite that indicated by the arrow x, by which the slide nose 4' which is held on a hook 4'' of said slide is carried along, there is provided a push button 9.

The push button 9 which can be depressed transversely to the direction of displacement of the blocking slide 4 passes through an opening 10 in the front plate and is furthermore under the action of a compression spring 11 which rests against the bottom 1' of the lock housing 1. The button 9 is hollow and contains, in part, the compressed spring 11. It furthermore has a cam surface 12 having an inclination of about 45°, which cooperates with a correspondingly extending mating surface 13 on a lateral extension 14 of the blocking slide 4.

Such a displacement in the direction opposite that of the arrow x is only possible when the corresponding opening-readiness position is present on the part of the lock ward. This position is verified by a combination resetting device. This device comprises a plurality of individually supported locking sleeves 15. Each locking sleeve 15 is formed on its circumference with an engagement space 16 which lies perpendicular to the bearing axis y—y. This engagement space cooperates with a projection 17 on the blocking slide 4, which projection can also be displaced perpendicular to the axis y—y. If the rotatably supported locking sleeves 15 are set in such a manner than their engagement spaces 16 lie practically coincident with the projections 17 of the blocking slide 4, then the blocking slide can be displaced against the force of the spring 5 in the direction towards unlocking, by means of the push button 9 and therefore in the direction opposite that of the arrow x.

On the other hand if at least one of the three locking sleeves 15 which are arranged alongside of each other, i.e. with parallel axis, is in a position not ready to receive the projection 17 which rests against it so that the projection lies in front of the outer surface of the locking sleeve 15, such a displacement is not possible.

Another component of the combination locking and resetting device is a separate disk 19 provided on its periphery with setting symbols 18. This disk is in coupling engagement with the locking sleeve 15 and is mounted coaxially to the latter. These symbols which optically indicate the individual positions of angular rotation appear individually in a window portion of the front plate 2. The individual viewing windows are designated 20. They lie in the plane of the axis y—y. In the embodiment shown by way of example, the symbols consist of Arabic numbers which lie, graduated from one to ten, on the periphery of the disk 19.

The turning displacement of the unit consisting of a locking sleeve 15 plus disk 19 takes place via in each case a push button D which is adjacent to the corresponding viewing window 20. These push buttons pass through openings 21 in the front plate 2. The turning is effected with the interposition of a stepping mechanism. For this purpose a switch finger 22 extends from that end of each push button D which is on the inner side of the lock. The bent actuating end 22' thereof extends between the teeth 23 of a star wheel St which is arranged on the wide side of the disk 19 facing the button. The teeth are arranged substantially radially. The star wheel can be formed on the disk 19 itself. The actuating stroke of the actuating end which is in the direction towards the bottom of the lock housing is of such a length that the disk 19 is displaced by an angular amount which brings the next symbol into the region of the viewing window. The spring 11 pushes the push button back into its basic position after it has been released. The switch finger in this connection is deflected elastically and engages into the next gap.

The angular positions reached in this connection can be maintained by friction or else by the inclusion of a detent ratchet R which consists of a spring washer 24 which is supported here on the wall side of the lock housing and the spring tongues 24' of which engage into one of the detent depressions **24'*a* arranged, in a manner corresponding to the angular graduation, on the wide side of the locking sleeve 15 which faces away from the push button D. One such one sided acting detent ratchet R is associated with each locking sleeve 15**.

The spring washer 24 can be provided with three spring tongues arranged, for instance, at an equal angle apart, which engage into the wide surface of sawtooth-like structure.

Figure 2:
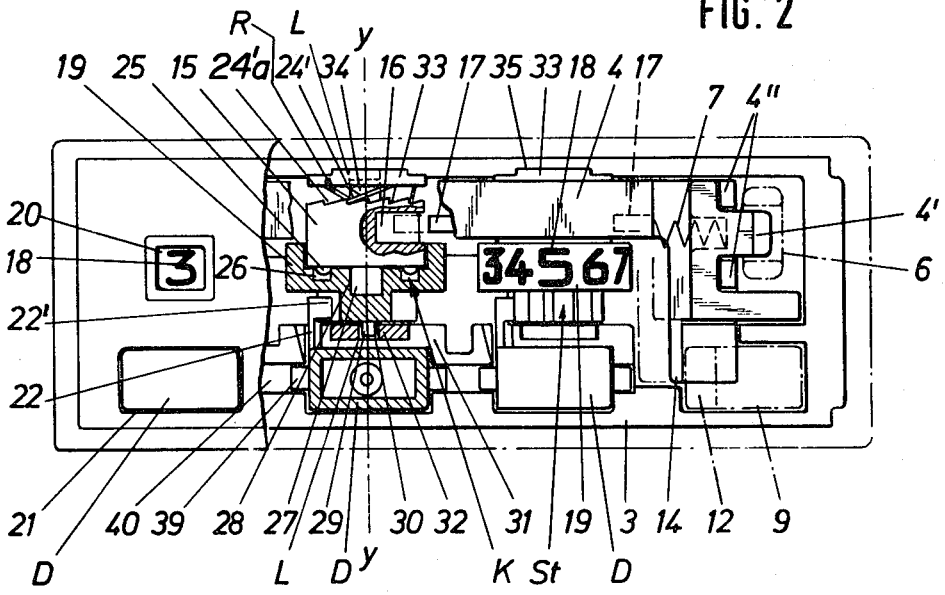
FIG. 2 is a top view of this permutation lock, partially broken away.
Figures 4, 5, 6, 7:
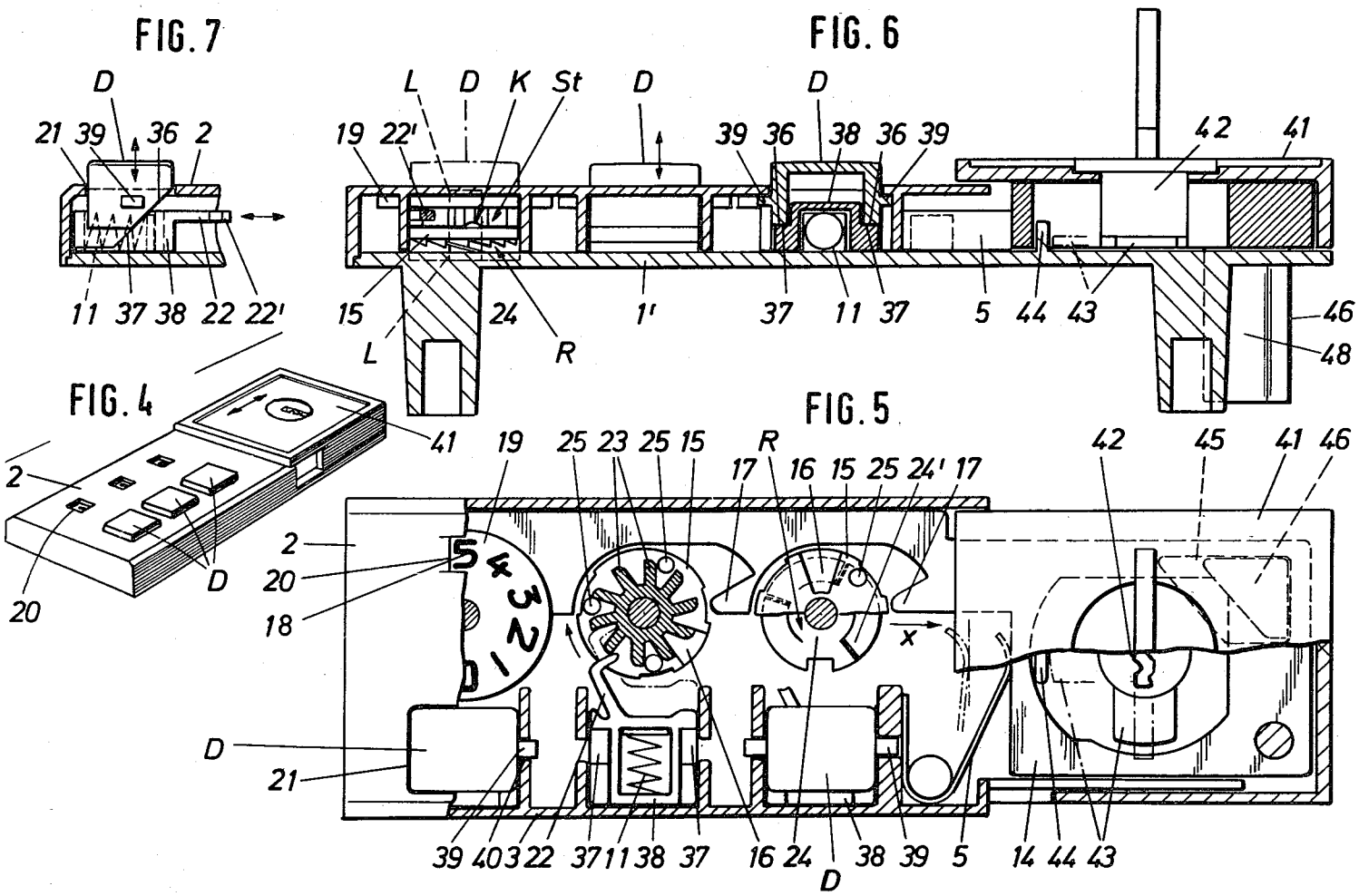
FIG. 4 shows in perspective the permutation lock in accordance with the second embodiment, which lock can be associated with the central closure shown in FIGS. 8 to 10.
FIG. 5 is a top view, on a larger scale than in FIG. 4, of this permutation lock, partially broken away.
FIG. 6 is a longitudinal section in different planes.
FIG. 7 shows a detail of the push-button formation of this lock.

A disk 19 and locking sleeve 15 of each unit are then connected together via a detent coupling K. The latter is formed in simple manner in the manner that the wide surface of the locking sleeve 15 which faces the push button D is provided with small dome-shaped detent projections 25, opposite and aligned with which there are detent depressions 26 in the corresponding adjoining wall of the disk 19. FIG. 2 shows the coupling engagement position. The corresponding engagement is under the action of the spring tongues 24' of the detent ratchet R.

In order to change the combination one proceeds as follows: The operator sets the previous coding position which makes it possible for him to displace the blocking slide 4 via the button 9 in the opening direction, the projections 17 entering into the engagement spaces 16. In this position all locking sleeves 15 are held against turning. In this position any of the buttons D can now be actuated. The switch finger 22 turns the disk 19 around the axis y—y, temporarily releasing the detent coupling between the parts 15 and 19. The detent projection 25 enters into the next following detent depression 26, and so on.

Upon release of the push button 9, the blocking slide 14 returns into its basic locking position.

The slight axial displacement of the locking sleeve 15 is taken into account by a correspondingly wide dimensioning of the engagement space 16.

The locking sleeve 15 may have, for instance, three detent projections 25 which are arranged at equal angles apart. The detent depressions 26 on the other hand are provided along a circular line in a distribution corresponding to the angular graduation.

The journal bearing L of the disks 19 and locking sleeves 15 is formed by stub shafts formed thereon. The formation is specifically such that a stub shaft 27 is seated centrally on the wide side of the locking sleeve 15 which faces the push button D. The stub shaft extends into a disc 19 28 in the disk 19. This depression forms, in the same direction, and therefore coaxially, a stub shaft 29. The stub shaft 29 engages either into an opening 30 in a partition wall 31 of the lock housing 1 or into a special push-in plate 32 which can be lowered from above into a correspondingly developed socket in the partition wall 31 of the lock housing 1.

A similar such plate 33 is present on the opposite journal bearing for this unit. This plate also has an opening, not shown, however, in detail here, for the entrance of a second stub shaft 34 of the locking sleeve 15, which stub shaft 34 extends centrally from the wide side there. The depth of this opening takes into account the necessary guide path for the axial disengagement stroke of the detent coupling K.

The plate 33 receives the spring washer 24 in a pocket which lies concentric to the opening (not shown) for the stub shaft 34. The plate 33 furthermore has a collar formed thereon which extends into a recess 35 of corresponding contour in the housing wall there. The recess in this case also represents a plug pocket. It is formed on the bottom side of the lock in the manner corresponding to the curvature of the section of the plate 33 which forms the pocket. The plate terminates slightly in front of the front plate 2 which directly covers it. The same applies with respect to the push-in plate 32, in which manner a non-displaceable journal mouting is obtained.

The embodiment in accordance with FIGS. 4 to 7 is, in principle, of the same construction, so that the reference numbers, insofar as required for understanding, have been transferred accordingly.

In the embodiment which is additionally described below, the ward is so incorporated in the lock housing 1 that a substantially flatter lock body is obtained. Thus the setting symbols 18 of the disks 19, whose wide sides face the front plate 2 and the housing bottom 1' are formed on the wide surface of the front-plate side. The detent ratchet R which has been explained in detail above as well as the detent coupling K which makes recoding possible have been implemented further. In the interest of the flat construction which is desired here, the spaces between the teeth 23 are used in the sense of the detent recesses 26.

In order, in this solution, also to permit a push-button actuation which can be effected from the front plate, the further development is such that the push button D in accordance with the second embodiment by means of an oblique surface 36, actuates a slide 38 which has the corresponding mating inclined surface 37, on which slide there is formed the elastically yielding switch finger 22 whose bent actuating end 22' enters, perpendicular to the direction of depression of the push button, between the teeth 23 of the star wheel St provided on the wide side of the disk 19, facing the bottom of the lock.

Inclined surface 36 and mating inclined surface 37 are at an angle of 45° to the housing bottom 1'.

The push buttons D of both embodiments form laterally directed noses 39 which are guided in slots 40 of the lock housing. These slots 40 are so dimensioned in the direction of depression that the bottom of the slot can in each case serve as a limiting stop. In the embodiment shown in FIGS. 1 to 3, the slots as well as further guide pockets for the push buttons are formed proportionally by the lock housing wall 3 there and the partition wall 31 while in the other embodiment they are formed also by transverse walls.

In the same way as the push button 9 which displaces the blocking slide 4, both the push buttons D and the slide 38 are hollowed out to such an extent that their inside can be used to contain the compression springs 11 which urge these parts in the direction opposite the direction of actuation.

As a further modification of the first embodiment, the blocking slide in accordance with FIGS. 4 to 7 is continued as a relatively large-surface slide button 41. This is a cap part which is set back slightly with respect to the width of the lock housing and which is riveted onto the extension 14 or coordinated with it in some other manner. The slide button 41 carries a lock cylinder 42. The free end thereof pointing in the direction of the lengthened housing bottom has a closure bit 43 which can be swung by a 90° turn in front of a blocking rib 44 so that a displacement of the blocking slide 4 in the direction opposite that of the arrow x and therefore opposite the spring 5 which is formed here as leaf spring is out of the question.

Figure 8:
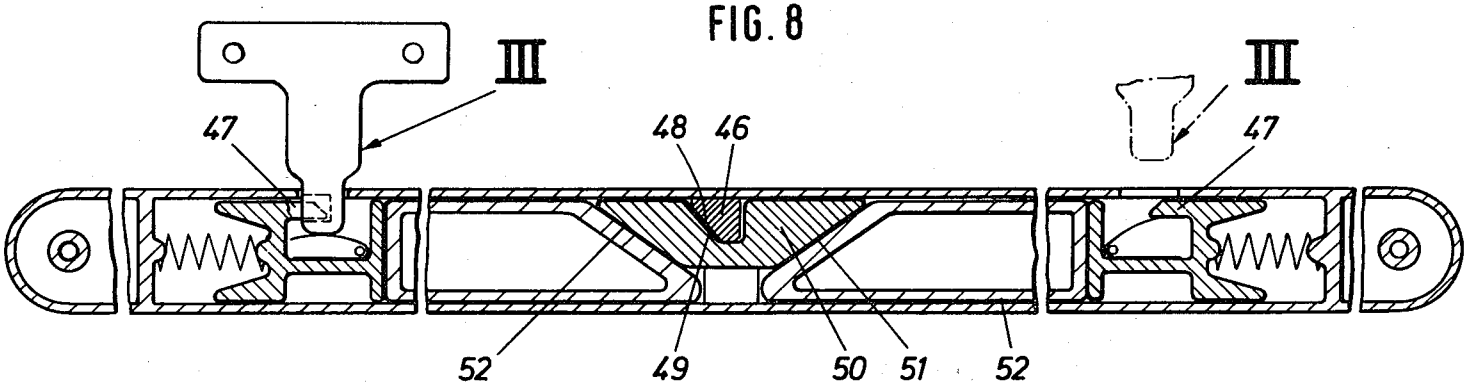
FIG. 8 is a longitudinal section through the central closure, shown in closed position.
Figure 9:
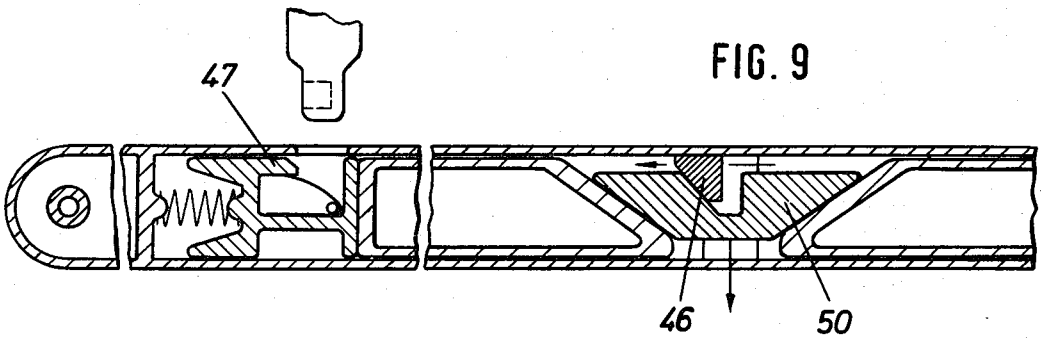
FIG. 9 is a showing, corresponding to FIG. 8, with the mating locking part released.
Figure 10:
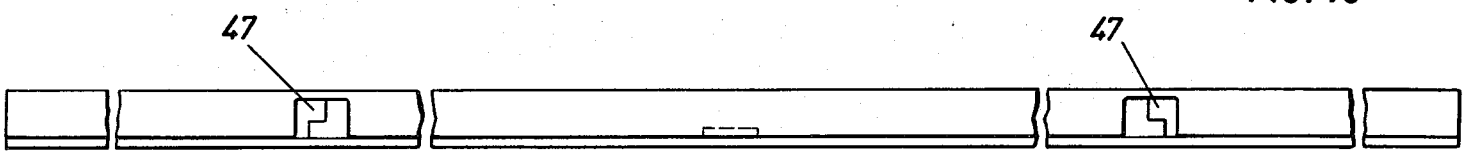
FIG. 10 is a top view of FIG. 8.
Figure 13:
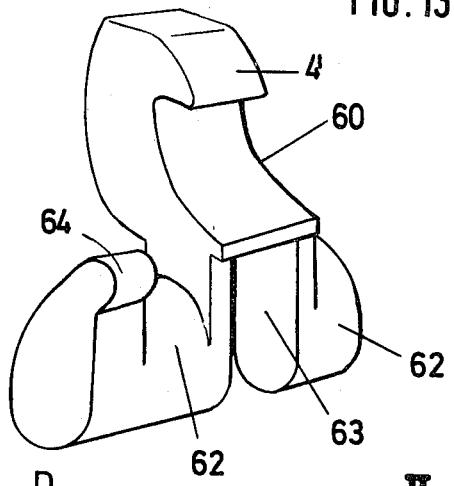
FIG. 13 shows the hook latch by itself in perspective.

In the unlocked condition on the other hand the corresponding displacement is possible, an actuating finger 46 which passes through an opening 45 in the bottom of the lock housing, opening two centrally controlled latches 47 of the central closure shown in FIGS. 8 to 10. The corresponding cam bevel 48 passes over a mating bevel 49 of a transversely guided, displaceable push piece 50. The outer surfaces 51, which converge in the direction of displacement and therefore are arranged obliquely, thereby slide the push pieces 52 apart, and the latter bring the latches 47, against the force of the latch springs acting upon them, out of blocking engagement with the closure tongues III.

The push buttons D in the embodiment shown in FIGS. 4 to 7 straddle the slide 38. The bevel surface 36 and mating surface 37 are located on both sides of the inner space which contains the spring 11 and therefore in the region of the relatively wide arms of the slide which is formed in the shape of a frame.

Figure 3:
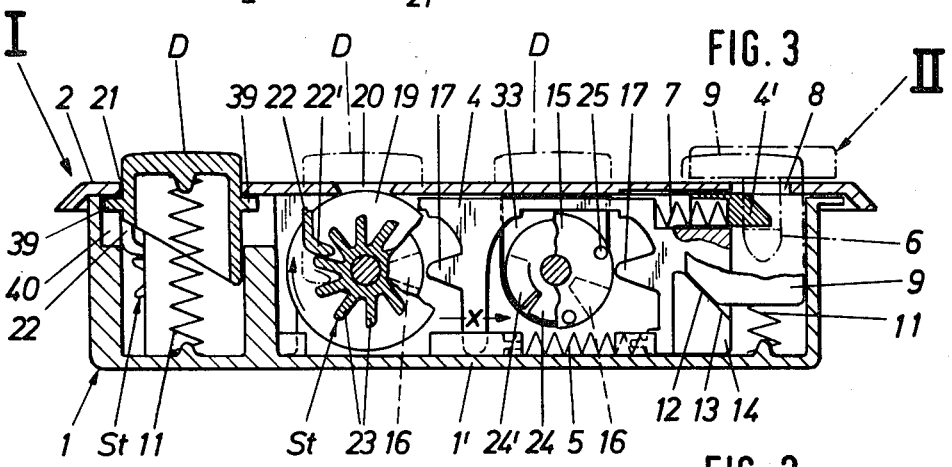
FIG. 3 is a longitudinal section through the lock of FIG. 2, shown in different sectional planes.

In the third embodiment (FIGS. 11 to 18) the blocking slide 4 is guided for longitudinal displacement on the bottom 1'. The latter is also biased by spring action, but in the direction opposite to the arrow x (FIG. 3). The spring 5, which at one end rests, fixed in position, against the housing end wall there, is formed as a convolution compression spring and acts against the hasp-side side end of the blocking slide 4. In the hasp-side region in front of the blocking slide 4 there is a hook latch 60. The nose 4' of the hook latch which lies in the region of the front plate 2 engages behind a projection 61 of the mating closure part II.

The spring 7 biases the hook latch 60 into this engagement position in this case also. It is here an approximately horizontally inserted leaf spring 7 which is brought into U shape. Its one arm, the upper arm 7', passes through a tunnel 63 in the hook latch 60, the tunnel extending to above the lateral latch pivot pins 62. The spring action takes place on the other side of the center point of the latch axis and thus in the direction of the basic engagement position. The other arm 7'' is supported fixed in position.

Figure 11:
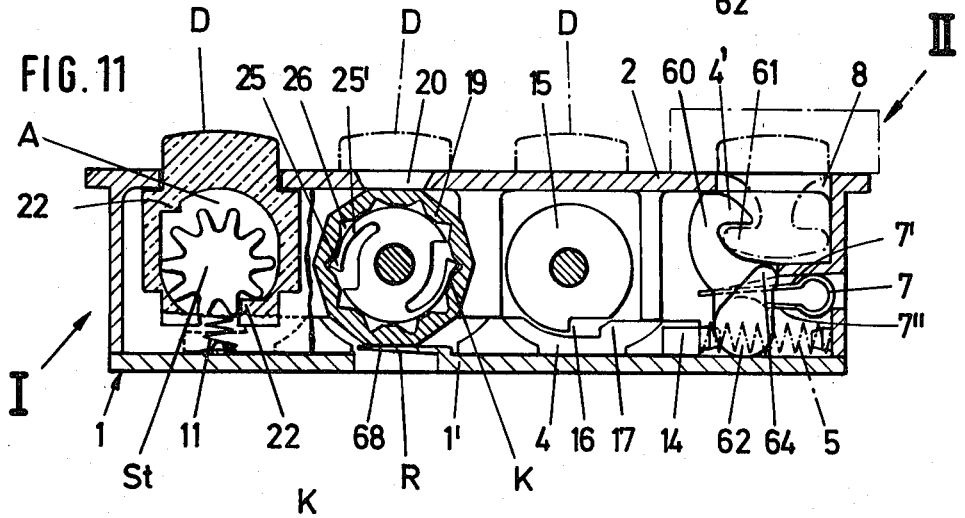
FIG. 11 is a longitudinal section through the permutation lock, shown in different sectional planes, in accordance with the third embodiment.
Figure 12:
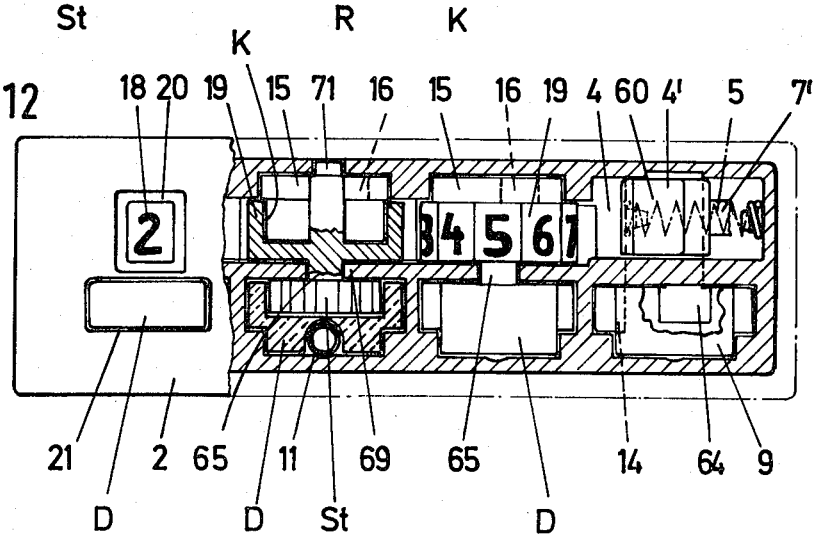
FIG. 12 is a top view of this permutation lock, partially broken away.
Figure 14:
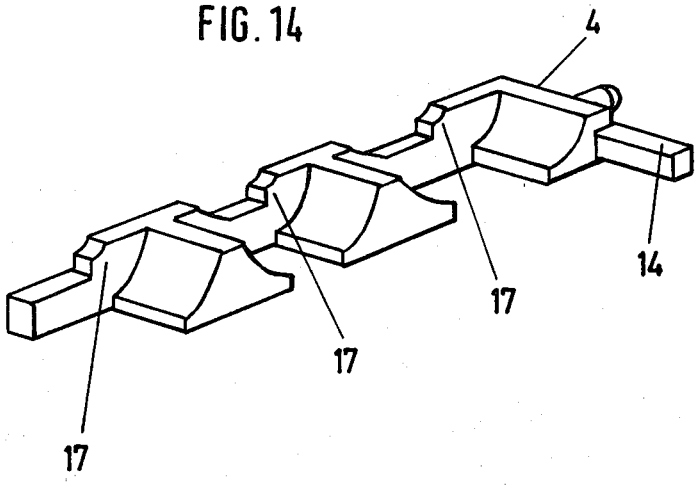
FIG. 14 shows the blocking slide by itself, in perspective.
Figure 15:
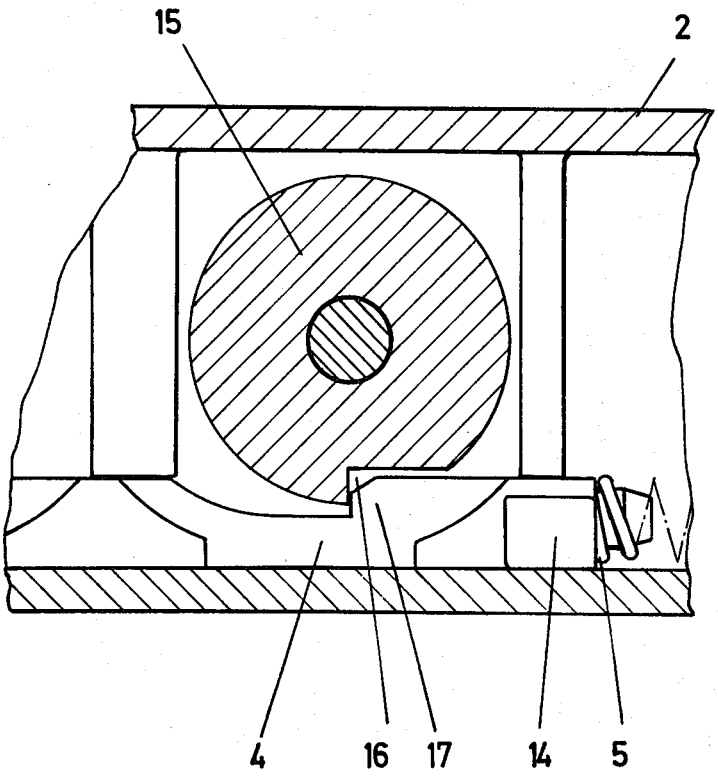
FIG. 15 is an enlarged view of a portion of the permutation lock in the region of the locking sleeve, showing the situation in which the projections have entered into the engagement spaces of the disks.
Figure 17:
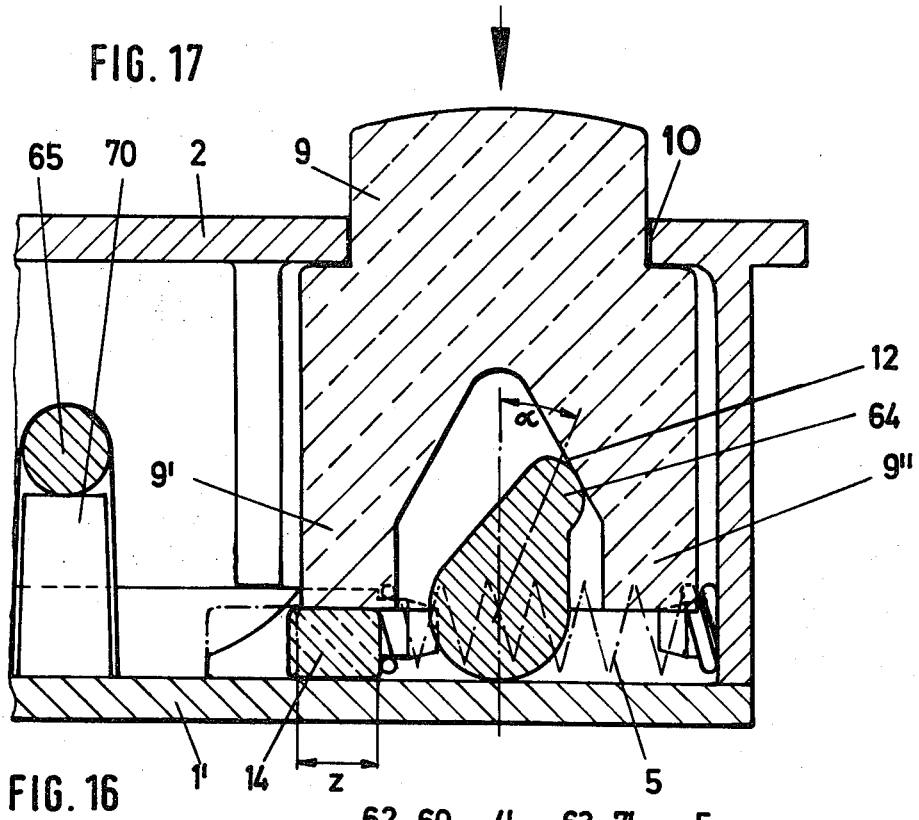
FIG. 17 is a section along the line XVII—XVII of FIG. 16.
Figure 16:
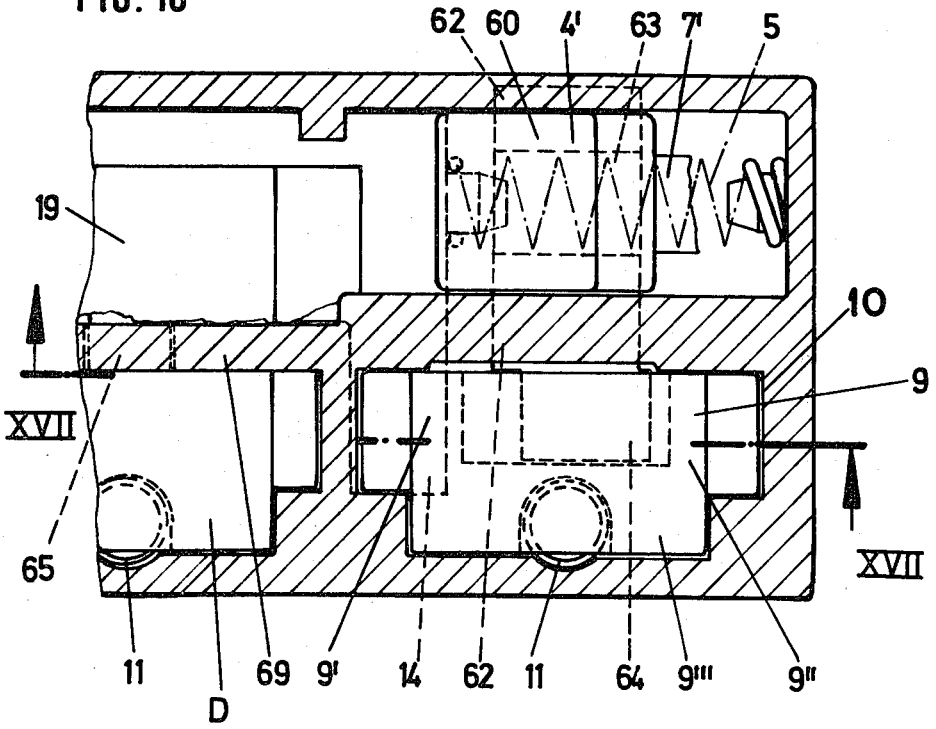
FIG. 16 is a cross section in the region of the opening-actuation knob of the permutation lock.
Figure 18:
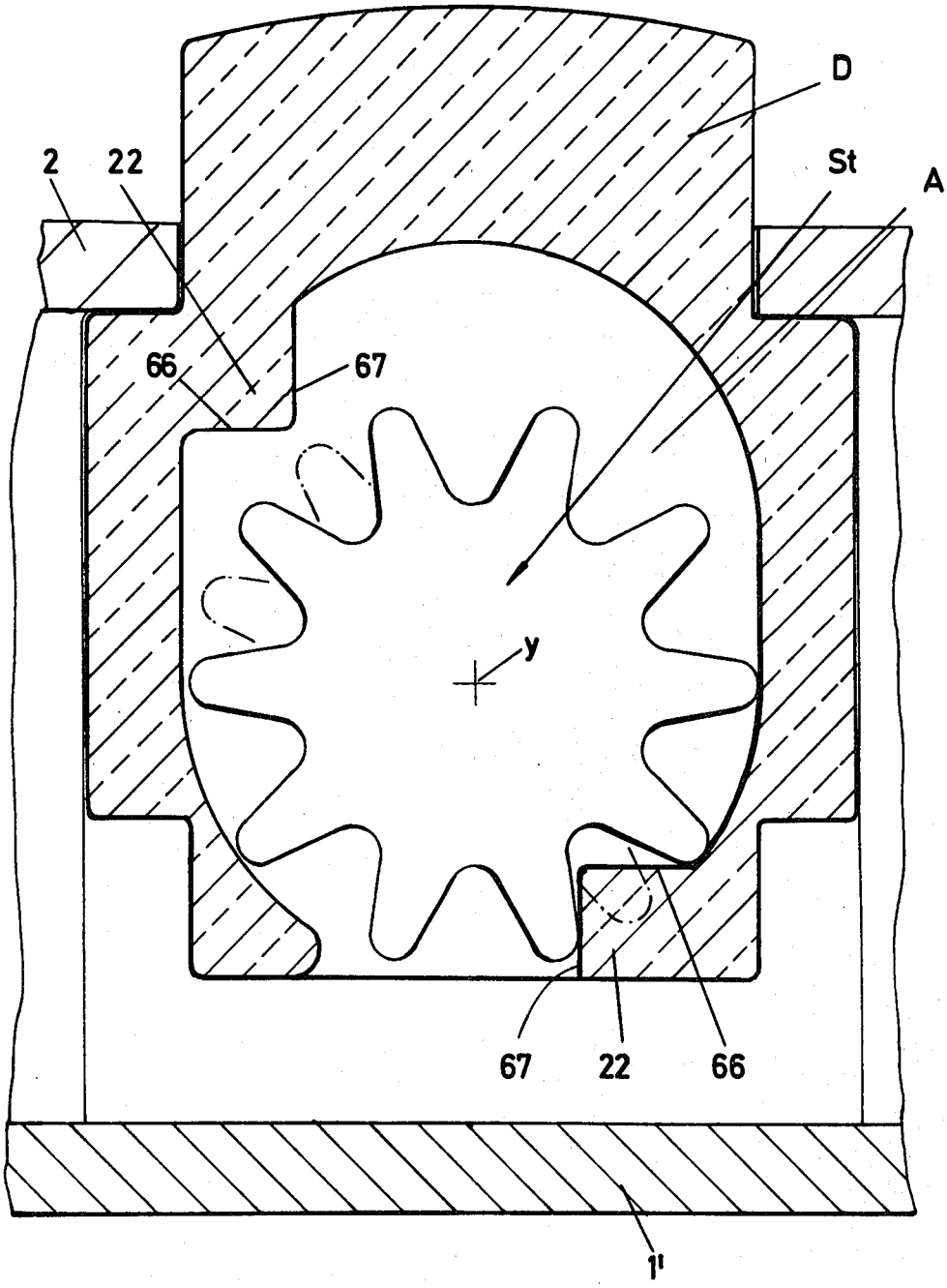
FIG. 18 shows the stepping mechanism by itself, on an even larger scale.

As can be noted from FIG. 11, the arms 7', 7'' lie in the upper region of the tunnel 63. The free space present in the tunnel below them serves for the crossing passage of the spring 5 which acts on the blocking slide 4 and the end turns of which grip, secured in position, over centering pins both on the hasp-side end wall of the housing and on the hasp-side end of the slide 4.

For the passage of that end of the mating closure part II which carries the projection 61, the front plate 2 has an opening 8. The projection 61 which strikes against the latch bevel of the nose 4' displaces the hook-latch nose 4' so that it swings around the latch pivot pin 62 mounted on the housing side into position of release without simultaneously displacing the blocking slide 4.

The displacement of the blocking slide 4 is effected solely by the blocking-slide spring 5 and only when the combination is properly set such that the projections 17 of the side 4 can pass into the spaces 16 in the locking sleeves 15.

An opening actuating knob developed as a push button 9 guided with limitation by an abutment stop is associated with the hook latch 60. The opening actuation knob which can be depressed transverse to the direction of displacement of the blocking slide 4 passes with its operating end through an opening 10 in the front plate 2 and is under the action of a compression spring 11 which rests against the bottom 1' of the lock housing 1 (see FIG. 16). The opening actuation knob is U-shaped in the region of its inner end (see FIG. 17). Its two U arms 9', 9'' are connected with each other by a web 9''' in the region of their side edges which point in the direction of one longitudinal wall of the housing. The web is recessed corresponding to the space required by the compression spring 11 which is perpendicular to the bottom 1' so that the spring is guided on the one hand by the wall of the recess and on the other hand by a partial recess in the region of the longitudinal wall of the housing.

The right hand U arm 9'' by its inner flank forms an obliquely extending cam surface 12. Upon the depression of the push button 9 (see arrow), this surface strikes against a cam projection 64 which is formed integral with the hook latch 60 and extends into the path of the push button 9. The angular range of swing is designated alpha in FIG. 17. It amounts to about 20° while the bevel of the cam surface 12 is about 30° to the vertical.

If the combination is incorrectly set, then the hasp-side end of the blocking slide 4, i.e. a lateral extension 14, lies in the region below the push button 9. In this way the actuation of the push button 9 is blocked. An attempted actuation of the opening actuation button which is otherwise effected has no influence on the blocking slide 4 in the sense of displacement and thus no effect on all the functional parts of the lock. The swinging out of the hook latch can, on the other hand, be effected without hindrance by means of the push button 9 as soon as the projections 17 which are formed on the blocking slide can enter into the engagement spaces 16 of the locking sleeves 15 of the combination blocking and resetting device and therefore move by the displacement stroke z, whereby the extension 14 no longer blocks the arm 9' of the push button 9. This device consists, in the embodiment shown by way of example, of three individually mounted locking sleeves 15. The peripheral engagement spaces 16 are developed in the manner that one flank is perpendicular to the mounting axis y—y of the locking sleeves and the other extends parallel to the top side of the plate-shaped blocking slide 4 which is developed in the form of a ledge. The projections 17 are of such shape that they can extend fully into these engagement spaces 16. The projection tip is broken off corresponding to the rounding of the cylindrical wall of the locking sleeves so that upon its resilient application against the periphery of the locking sleeves no notching or catching can occur. In the blocking engagement position the extension 14 has moved out of the path of actuation of the opening actuating button 9 so that the latter can be pushed unimpeded in the direction towards the bottom 1', the hook latch 60 then being swung away by means of the cam projection 64.

On the other hand, if at least one of the three locking sleeves 15 which are arranged alongside of each other, i.e. with parallel axis, is in a non-reception position for the projection 17 which scans it, so that said projection lies on the cylindrical surface of the locking sleeve 15, such a displacement is not possible.

Another component of the combination locking and resetting device comprises the individual disks 19 provided on their periphery with setting symbols 18. Each of the disks is in coupling engagement with a corresponding locking sleeve 15 and is mounted coaxial to it. These symbols, which visually indicate the individual positions of angular rotation appear individually in a windowed portion of the front plate 2. The individual viewing windows are designated 20. They lie in the vertical plane passing through the axis y—y. A graduation from zero to ten is present on the periphery of the disk 19.

The angular displacement of the unit consisting of the locking sleeve 15 and disk 19 is effected in each case via a displaceable push button D, the path of which is limited by a stop and which is arranged in each case adjacent to the corresponding viewing window 20. These push buttons D extend, in a manner accessible to interference, into openings 21 in the front plate 2. The angular actuation is effected in this case also by means of a stepping mechanism. An essential component of the latter is a rotatable starwheel St. The latter is continued via a journal pin 65 into the disk 19. It can be formed directly on the disk. The ten teeth are directed radially in spoke-like manner equally spaced apart. The actuating stroke which is in the direction towards the bottom of the lock housing, is of such a length that the disk 19 is displaced by a full angular amount, as a result of which the next symbol appears in the viewing window 20. The actuating stroke is in this connection, however, divided up in that upon the downward depression of the actuating button D one half of the rotary displacement of the star wheel St is effected, while upon the spring-induced backward displacement of the button D into the initial position the other half is produced. For this purpose, two switch fingers 22 are associated with the star wheel, which extends into a recess A in the push button. These switch fingers are formed by a corresponding shaping of the recess. Each finger has a driving flank 66 and a blocking flank 67. Upon the downward displacement of the upper switch finger 22 which lies to the left of the axis y—y the bottom switch finger 22 lying to the right of said axis passes simultaneously from its engagement position which secures the star wheel against turning, out of the tooth gap present there. However, in this connection the blocking flank 67 of the lower switch finger 22 initially still rests against the tooth flank of the star wheel tooth lying in front of it. Only after the blocking flank 67 has left this star wheel tooth flank does the driving flank 66 of the upper switch finger 22 come against the star wheel tooth below same. The latter assumes an acute-angle position with respect to the horizontal driving flank 66. The star wheel is now turned by the driving flank 66 through one-twentieth of a full circle. In this connection, the star wheel tooth which follows the engaged star wheel tooth comes against the blocking flank 67 of said upper switch finger, which flank is also lowered. After passage through the complete downward stroke, all additional rotary displacement is therefore prevented by the upper switch finger. The lower switch finger 22 now engages the star wheel tooth which has come into its region of movement, that is in front of the driving flank, so as, upon the upward displacement, now to effect the remaining rotation of the star wheel St. This displacement is effected by the force of the push-button return spring 11.

The angular position reached can be secured in the manner described or else by inclusion of an additional detent ratchet R, in the form of spring tongues 68 which are cut out of the bottom 1' and rest against the periphery of the disks 19. This periphery is developed in uniformly polygonal fashion, as a result of which the flatresting spring tongue 68 precisely defines the corresponding angular positions. As stated, this development can be provided as an additional measure, since an angle detention is already achieved via the stepping mechanism.

The disk 19 and locking sleeve 15 of each unit are then connected with each other via a detent coupling K. The latter is formed in simple fashion in the manner that the disk is recessed in the shape of a pot on its side facing the locking sleeve 15 and equipped with equal-angle detent depressions 26 into which there engage detent projections 25 on the locking sleeve 15 which is mounted on a stub shaft of the disk. The development hereof can be noted from FIG. 11. As can be seen, the detent projections 25 are seated on lugs 25' which are cut out of an extension which extends into the pot space of the disk 19. Two detent projections 25 are provided, located diametrically opposite each other.

In order to change the combination one proceeds as follows: The operator sets the previous combination. The blocking slide 4, which is under spring action, pushes the detent projections 17 into the engagement spaces 16. In this position, all locking sleeves 15 are also blocked against rotation by the projections therein so that the buttons D, with the blocking slide 4 being held fast, can be selectively actuated so as to change the combination. While overcoming the detent coupling K, the disk 19 is in this manner displaced via the switch fingers 22, therefore with temporary elimination of the detent coupling between the parts 15 and 19. The detent projections 25 extend into the next following detent depression 26, and so on.

The holding fast of the blocking slide 4 during this change operation is effected by means of the opening actuation button, i.e. the push button 9 must be depressed as a result of which the blocking slide 4 is prevented from effecting, against the force of the spring 5, a displacement which would otherwise be causes by a rotation of the blocking sleeves 15. Its extension 14 rather comes against the side flank of the push button 9 which is in its way and which therefore has still another function.

For the introduction of all functional parts of the lock parts it is possible, in an advantageous manner, to use the journal pins 65 by placing them in slots of a middle wall 69 which is formed directly on the housing. From the bottom 1' there extend projections 70 which are formed directly thereon and each of which closes off the bottom of the corresponding mounting place.

The other end of the shaft which passes through the pot space of the disk extends as a stepped-down stub 71 into a corresponding mounting recess in the longitudinal side wall of the lock housing 1. The stub 71 can be covered by a lead-in clip-on shoulder.

We claim:

1. In a permutation lock with an opening actuating handpiece and with a plurality of axle-mounted discs which bear symbols, which lie behind viewing windows in a front plate of the lock housing and lock in their individual angular positions, and adjacent thereto with locking sleeves which have engagement spaces for projections of a spring-biased blocking slide which is actuatable from the outside, the engagement spaces being opposite to the direction of movement of the projections of the blocking slide when the combination is properly set, the improvement wherein said discs constitute separate discs, a push button adjacent each of said viewing windows associated with each of said discs, respectively, stepping means for actuating said separate discs, respectively, via said push buttons, respectively, said lock housing has a lock wall formed with a recess and spaced therefrom has a partition wall formed with a first opening, axle bearing means for rotatably mounting a pair of said discs and locking sleeves, respectively, to said lock housing, comprising, a first stub shaft and a second stub shaft formed on opposite sides of said locking sleeve, said disc is formed with a first recess and a third stub shaft, said first stub shaft of said locking sleeve is disposed in said first recess of said disc, a plate has a collar mounted in said recess of said lock wall, said plate is formed with a second opening, said second stub shaft of said locking sleeve is disposed in said second opening, a push-in plate is formed with a third opening and is disposed in said first opening of said partition wall, and said third stub stub shaft of said disc is disposed in said third opening in said push-in plate, a detent ratchet means has spring tongues mounted on said first-mentioned plate for axially resiliently holding said first and third stub shafts in said first recess and said third opening, respectively.

2. In a permutation lock with an opening actuating handpiece and with a plurality of axle-mounted discs which bear symbols, which lie behind viewing windows in a front plate of the lock housing and lock in their individual angular positions, and adjacent thereto with locking sleeves which have engagement spaces for projections of a spring-biased blocking slide which is actuatable from the outside, the engagement spaces being opposite to the direction of movement of the projections of the blocking slide when the combination is properly set, the improvement wherein said discs constitute separate discs, a push button adjacent each of said viewing windows associated with each of said discs, respectively, stepping means for actuating said separate discs, respectively, via said push buttons, respectively, means for spring-biasing said blocking slide in the direction of movement towards the engagement spaces, said locking sleeves constitute means for moving said blocking slide into a blocking position blocking said opening actuating handpiece, said spring-biasing means for moving said blocking slide out of said blocking position when the combination is properly set, a hook latch is coordinated to the opening actuating handpiece, the latter constitutes means for moving said hook latch into a release position.

3. The permutation lock according to claim 2, wherein said opening actuation handpiece constitutes an opening actuating push button having a U-shape at an inner end forming two U arms and a web connecting side edges of said two U arms, said blocking slide has an end positioned below one of said U arms when the combination is not properly set, the other of said U arms is formed with an inner flank, said hook latch is formed with a control projection operatively abutting said inner flank of said other U arm, a return spring operatively biases said opening actuating push button and acts on said web.

4. The permutation lock according to claim 3, wherein said hook latch is formed with a tunnel, said spring-biasing means traverses said tunnel, another return spring operatively biases said hook latch and engages the latter in said tunnel.

5. The permutation lock according to claim 2, further comprising a star wheel on a wide side of each of said discs, said star wheel has teeth, said stepping means has two switch fingers spaced laterally apart from each other opposite said star wheel, each of said switch fingers has a driving flank and a blocking flank disposed relative to said teeth of said star wheel such that alternately upon inward and outward displacement of said push button, respectively, said blocking flank of one of said switch fingers extends substantially parallel to and against a flank of one of said teeth of said star wheel and said driving flank of the other of said switch fingers strikes at an acute angle against another one of said teeth of said star wheel, respectively.

6. In a permutation lock with an opening actuating handpiece and with a plurality of axle-mounted discs which bear symbols, which lie behind viewing windows in a front plate of the lock housing and lock in their individual angular positions, and adjacent thereto with locking sleeves which have engagement spaces for projections of a spring-biased blocking slide which is actuatable from the outside, the engagement spaces being opposite to the direction of movement of the projections of the blocking slide when the combination is properly set, the improvement wherein said discs constitute separate discs, a push button adjacent each of said viewing windows associated with each of said discs, respectively, stepping means for actuating said separate discs, respectively, via said push buttons, respectively, a star wheel on a wide side of each of said discs, said star wheel has teeth, said stepping means has two switch fingers spaced laterally apart from each other opposite said star wheel, each of said switch fingers has a driving flank and a blocking flank disposed relative to said teeth of said star wheel such that alternately upon inward and outward displacement of said push button, respectively, said blocking flank of one of said switch fingers extends substantially parallel to and against a flank of one of said teeth of said star wheel and said driving flank of the other of said switch fingers strikes at an acute angle against another one of said teeth of said star wheel, respectively.

* * * * *